US007416333B2

(12) United States Patent
Zhang et al.

(10) Patent No.: US 7,416,333 B2
(45) Date of Patent: Aug. 26, 2008

(54) AIR FLUX DIRECTOR SYSTEM FOR X-RAY TUBES

(75) Inventors: Shengzhong Zhang, Naperville, IL (US); Quin Kelvin Lu, Aurora, IL (US); Kevin C. Kraft, Bolingbrook, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/596,241

(22) PCT Filed: Dec. 2, 2004

(86) PCT No.: PCT/IB2004/052639

§ 371 (c)(1), (2), (4) Date: Jun. 6, 2006

(87) PCT Pub. No.: WO2005/057991

PCT Pub. Date: Jun. 23, 2005

(65) Prior Publication Data

US 2007/0098144 A1 May 3, 2007

Related U.S. Application Data

(60) Provisional application No. 60/528,533, filed on Dec. 10, 2003.

(51) Int. Cl.
*H01J 35/10* (2006.01)

(52) U.S. Cl. ..... 378/199; 378/200

(58) Field of Classification Search ..... 378/119, 378/127–130, 199, 120, 200
See application file for complete search history.

(56) References Cited

U.S. PATENT DOCUMENTS

| | | | | |
|---|---|---|---|---|
| 4,634,342 | A * | 1/1987 | Rodewald | 415/211.2 |
| 5,956,383 | A * | 9/1999 | Kendall | 378/199 |
| 6,997,609 | B2 * | 2/2006 | McCarthy, Jr. | 378/200 |
| 2004/0022362 | A1 * | 2/2004 | McCarthy, Jr. | 378/200 |

FOREIGN PATENT DOCUMENTS

| | | |
|---|---|---|
| FR | 2350484 | 12/1977 |

* cited by examiner

*Primary Examiner*—Irakli Kiknadze

(57) ABSTRACT

A cooling system (12) for an x-ray tube assembly (10) includes a heat exchanger (14, 16) which receives cooling fluid from a housing (40) of the x-ray tube assembly and transfers the heat to a flow of air. A fan (90), such as an axial fan, directs the flow of air through the heat exchanger. The fan is positioned within a duct (78). A contoured air flux director (110) is positioned to intercept the flow of air from the duct and to redirect the flow of air in a direction which is generally perpendicular to an axis of rotation of the fan.

19 Claims, 10 Drawing Sheets

AIR FLUX DIRECTOR SYSTEM FOR X-RAY TUBES

CROSS REFERENCE TO RELATED CASES

Applicants claim the benefit of Provisional Application Ser. No. 60/528,533, filed Dec. 10, 2003.

The present application relates to the x-ray tube arts. The invention finds particular application in removing heat from a cooling liquid used to cool an x-ray tube and will be described with particular reference thereto. It will be appreciated, however, that the invention finds application in a variety of applications where it is desirable to transfer heat efficiently.

X-ray tubes typically include an evacuated envelope made of metal or glass, which is supported within an x-ray tube housing. The envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100-200 kV, is applied between the cathode assembly and the anode assembly. The electron beam strikes the target with sufficient energy that x-rays and a large amount of heat are generated.

The x-ray tube housing surrounding the x-ray tube is filled with a fluid such as oil to aid in cooling the x-ray tube. In order to distribute the thermal loading created during the production of x-rays, a constant flow of cooling liquid is maintained throughout x-ray generation. After circulating through the x-ray tube housing, the cooling liquid is passed through a heat exchanger. The heat exchanger causes the heat stored in the oil to be radiated to the surrounding air, to transfer the heat by convection. The cooled oil is recirculated to the x-ray tube housing. A fan is typically used to direct air past or through the heat exchanger, to enhance heat transfer.

In computed tomography (CT) scanners, the x-ray tube and its associated heat exchanger and cooling fan are mounted to an annular rotating gantry. The gantry is rapidly rotated around the patient to acquire a CT image. The weight of the heat exchanger and its associated fan play an important role in maintaining balance of the gantry during rotation. The size of the heat exchanger is also limited by the clearance constraints of the gantry. As thermal outputs of x-ray tubes increase, it is difficult for conventional fans to provide the high flow rates needed to maintain adequate cooling without being too heavy to achieve gantry balance. Additionally, larger fans tend to be noisy, which can disturb the patient.

The present invention provides a new and improved method and apparatus which overcome the above-referenced problems and others.

In accordance with one aspect of the present invention, a cooling system for use with an associated x-ray tube assembly is provided. The cooling system includes a heat exchanger which receives cooling fluid from a housing of the associated x-ray tube assembly and transfers heat between the cooling fluid and a flow of air. A fan is disposed to move the flow of air through the heat exchanger. An air flux director is positioned to intercept the flow of air from the heat exchanger and to redirect the flow of air in a direction which is generally perpendicular to an axis of rotation of the fan.

In accordance with another aspect of the invention, an x-ray tube assembly and cooling system is provided. The assembly includes an x-ray tube for generation of x-rays. A fluid flow path carries heated cooling fluid from the x-ray tube to a cooling system and returns cooled fluid to the x-ray tube. The cooling system includes an axial fan which is disposed to move a stream of air past a portion of the flow path, the fan having an axis of rotation. An air flux director is axially spaced from the fan and shaped to deflect air radially which has been exhausted by the fan.

In accordance with another aspect of the invention, a method for cooling an x-ray tube assembly is provided. The method includes receiving a heated cooling liquid from the x-ray tube through a fluid flow path. Heat is transferred between the cooling liquid and a flow of air generated by a fan. The fan exhausts the air flow in a direction generally parallel with its axis of rotation. The exhausted air is deflected in a direction which is generally perpendicular with the axial direction.

One advantage of at least one embodiment of the present invention is that it enables high cooling rates to be achieved without increasing the weight of a cooling system.

Another advantage of at least one embodiment of the present invention is that it allows more than one heat exchanger to operate side by side, thereby increasing the rate of cooling.

Another advantage of at least one embodiment of the present invention is that fan noise is reduced.

Another advantage of at least one embodiment of the present invention is that vibration is reduced.

Another advantage of at least one embodiment of the present invention resides in extend x-ray tube life.

Still further advantages of the present invention will become apparent to those of ordinary skill in the art upon reading and understanding the following detailed description of the preferred embodiments.

The invention may take form in various components and arrangements of components, and in various steps and arrangements of steps. The drawings are only for purposes of illustrating a preferred embodiment and are not to be construed as limiting the invention.

Figure 1:
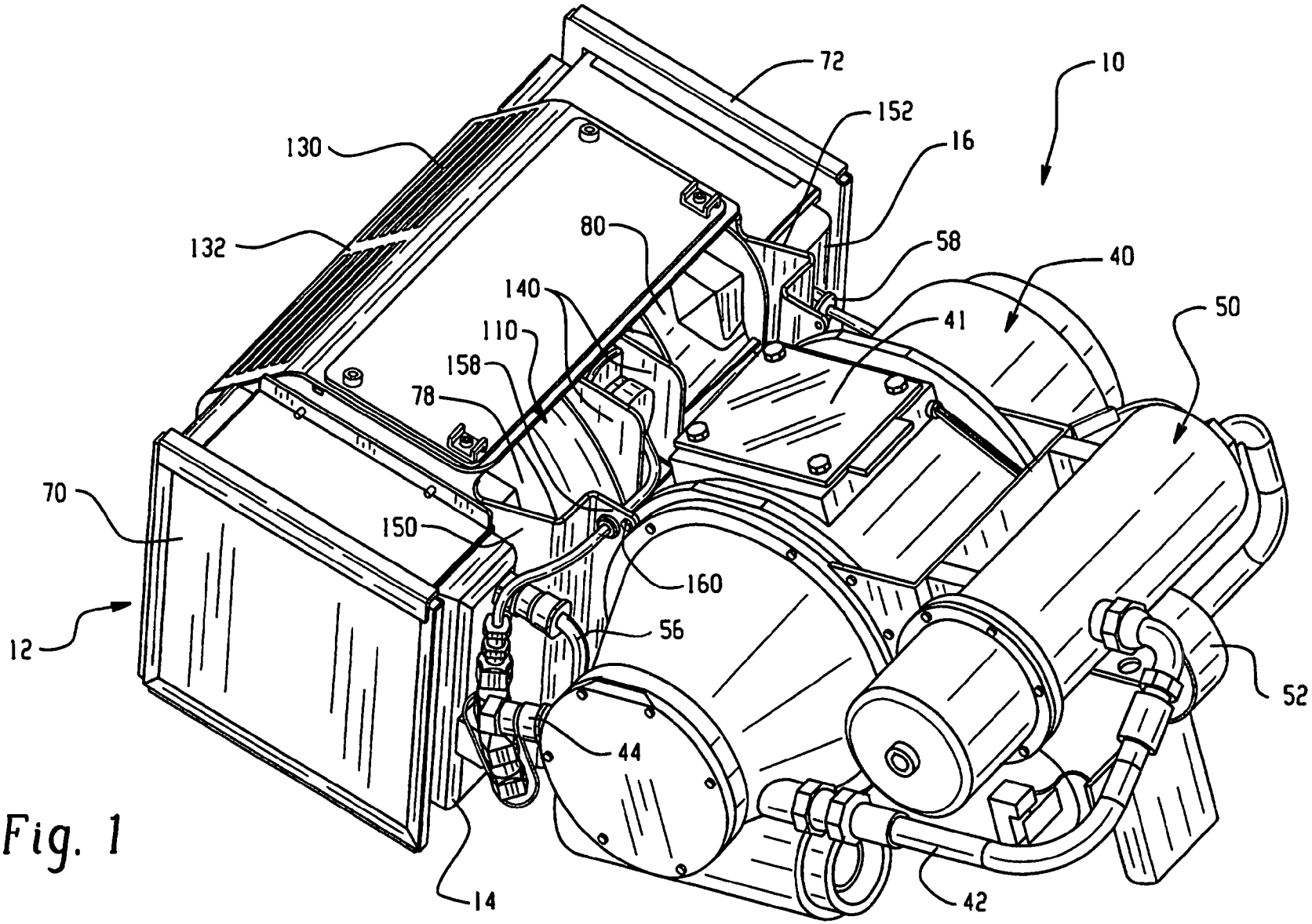
FIG. 1 is a perspective view of an x-ray tube assembly and cooling system according to the present invention.

With reference to FIG. 1, an x-ray tube assembly 10 of the type used in medical diagnostic systems, such as computed tomography (CT) scanners, for providing a beam of x-ray radiation is shown. The x-ray tube assembly 10 is cooled by a cooling system 12 including at least one a heat exchanger 14, 16. Two heat exchangers 14, 16 are shown in the illustrated embodiment, arranged in parallel.

Figure 2:
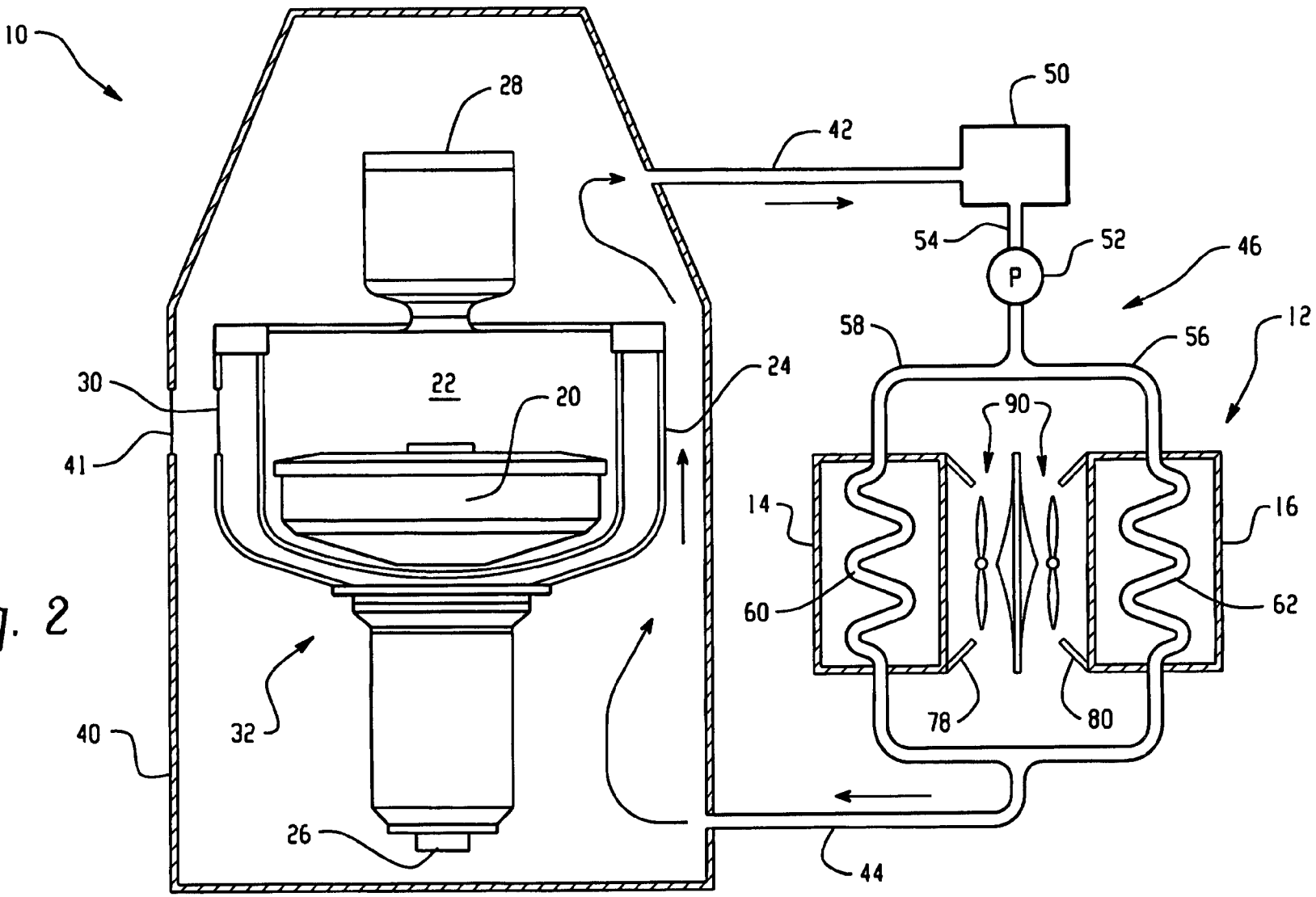
FIG. 2 is diagrammatic illustration of the x-ray tube and the cooling system of FIG. 1, partially cut away to reveal an anode assembly.

With reference now to FIG. 2, the x-ray tube assembly 10 includes an anode assembly 20 which is rotatably mounted in an evacuated chamber 22, defined by an envelope or frame 24, typically formed from metal glass, and/or ceramic. The x-ray tube anode assembly 20 is mounted for rotation about an axis via a bearing assembly shown generally at 26. A heated element cathode assembly 28 supplies and focuses electrons. The cathode is biased, relative to the anode, such that the electrons are accelerated to the anode 20. A portion of the electrons striking a target area of the anode is converted to heat and x-rays, which x-rays are emitted through a window 30 in the frame. The anode assembly 20, cathode assembly 28, and frame 24 together comprise an x-ray tube 32.

The x-ray tube assembly 10 also includes a housing 40 filled with a heat transfer and electrically insulating cooling fluid, such as a dielectric oil. The housing 40 at least partly surrounds the frame 24 of the x-ray tube and defines a window 41 through which x-rays leave the x-ray tube assembly 10. The cooling liquid is directed to flow past the window 30, the frame 24, bearing assembly 26, and other heat-dissipating components of the x-ray tube 32.

The cooling liquid is cooled by the cooling system 12. Specifically, heated cooling liquid leaves the housing 40 through an outlet line 42, located at the cathode end of the housing, is cooled by the cooling system, and the cooled liquid returns to the housing by a return line 44, located at an anode end of the housing. The lines 42, 44 may be in the form of flexible hoses, metal tubes, or the like and form part of a fluid flow path 46 which carries the cooling liquid through the heat exchangers 14, 16 of the cooling system.

An accumulator 50 in the fluid flow path 46 accommodates changes in volume of the cooling liquid due to temperature fluctuations. The cooling liquid is pumped through the flow path 46 by a liquid pump 52, which in the illustrated embodiment, is located in a fluid line 54, intermediate the accumulator 50 and the heat exchangers 14, 16, although other locations are also contemplated. Downstream of the pump 52, the cooling liquid is split into two lines 56, 58, one line going to each of the heat exchangers 14, 16. Within the respective heat exchanger 14, 16, the cooling liquid is directed along a convoluted radiator path, illustrated by tubing 60, 62, while air flowing through the heat exchanger contacts the tubing and is heated thereby. The heat exchanger may include fins (not shown) for increasing the surface area for heat dissipation. In one embodiment, the heat exchanger is formed from aluminum or other lightweight material and has about 6 fins/cm. A heat exchanger of about 20 cm×20 cm×9 cm provides sufficient cooling capacity for an x-ray tube of about 4-6 KW power while meeting conventional gantry clearance constraints.

Figure 3:
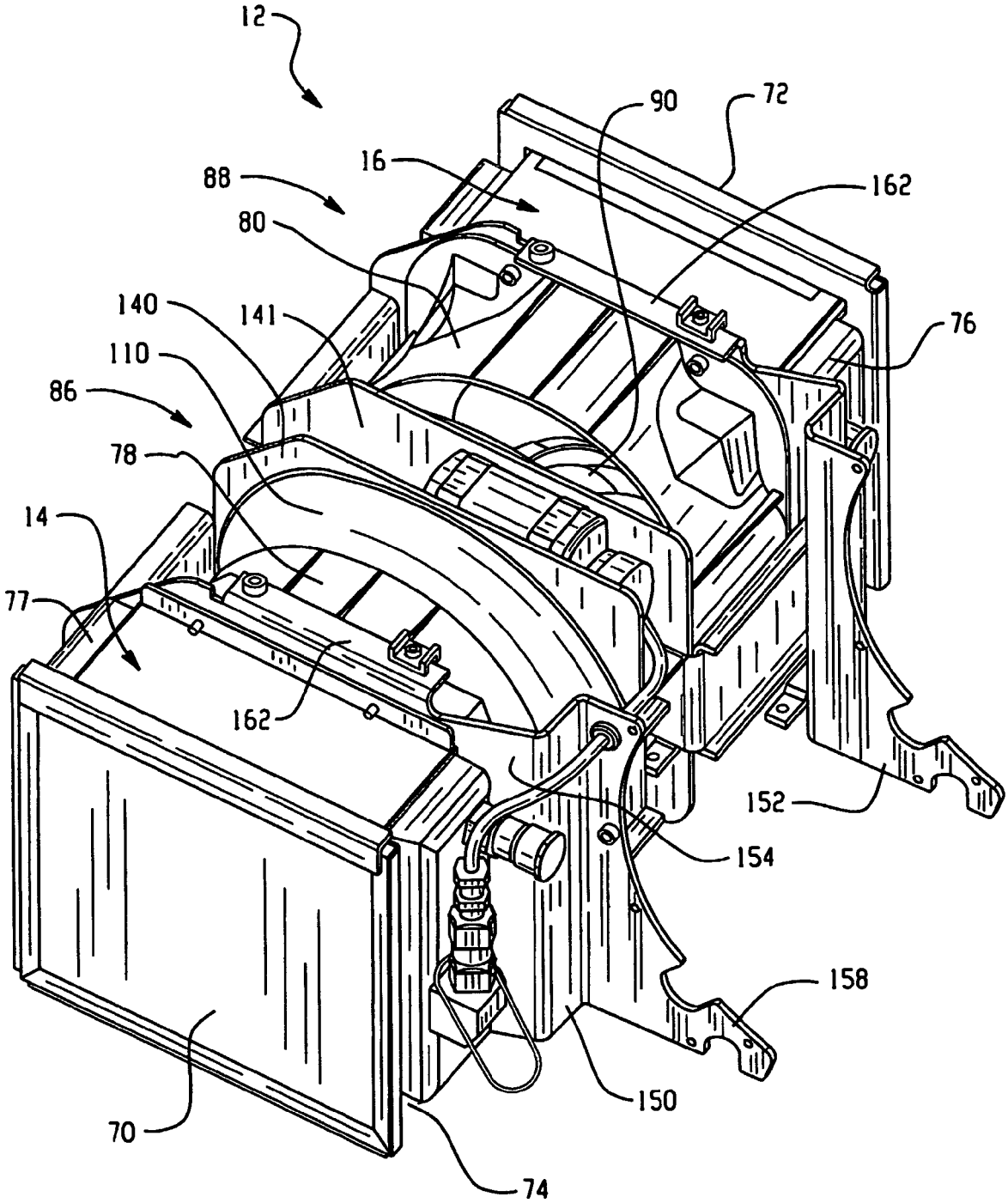
FIG. 3 is an enlarged perspective view of the cooling system of FIG. 1, with the fan cover removed for clarity.
Figure 4:
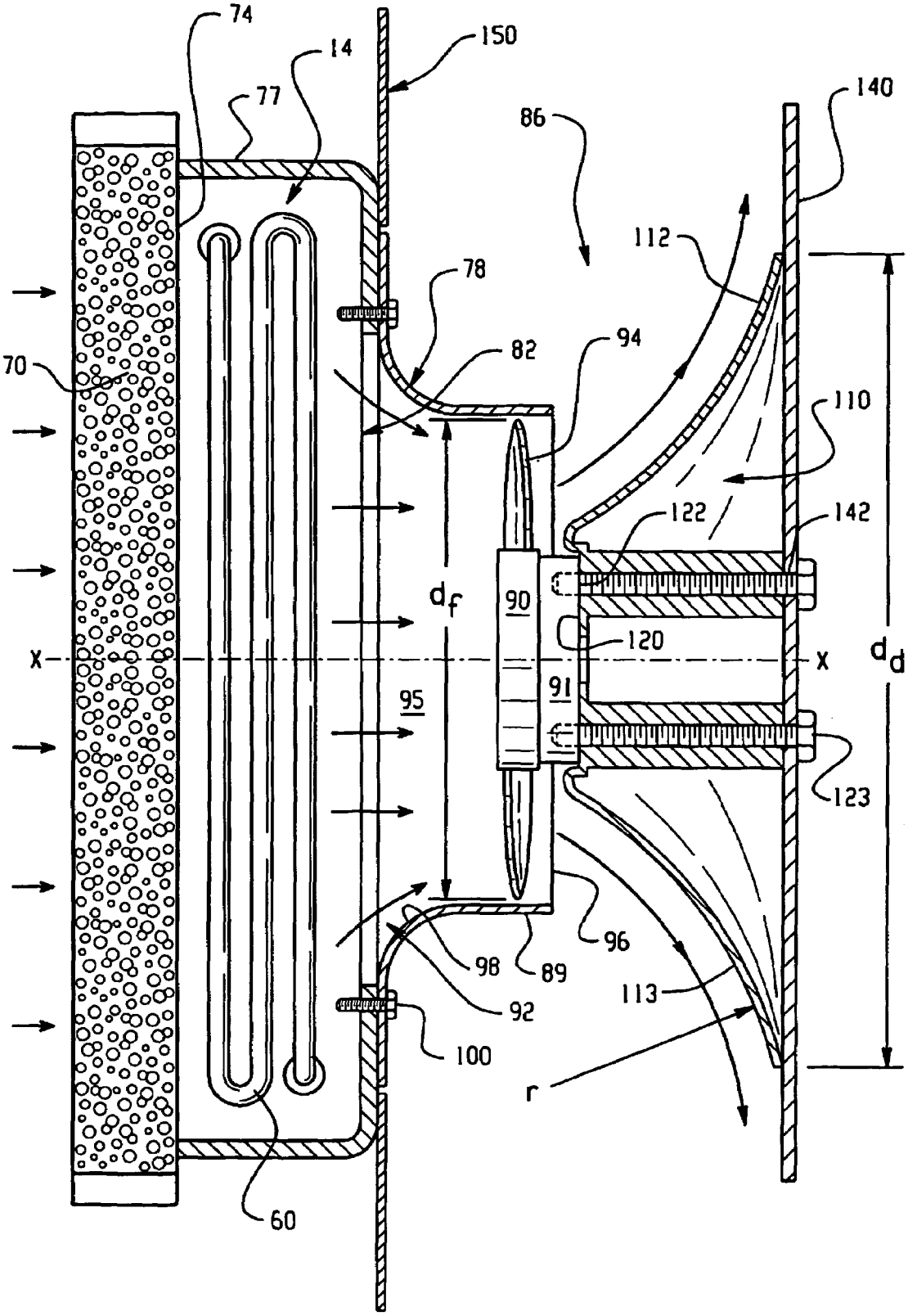
FIG. 4 is a schematic side sectional view of part of the cooling system of FIG. 3.

With reference now to FIGS. 3 and 4, cooling air from the surrounding environment enters the heat exchanger 14, 16 via a filter 70, 72, mounted across an inlet port 74, 76 defined by a housing 77 of the respective heat exchanger 14, 16. The filter 70, 72 can be of any conventional type, such as a foam. The density of the foam is preferably fine enough to catch dust that could inhibit the efficiency of the heat exchanger, but not so fine that it reduces the system's cooling efficiency. In one embodiment, a foam density of about 25 PPI is employed. The filter may be omitted if the design of the heat exchanger permits.

The air flow, heated by contact with the tubing 60, 62 and fins, exits the heat exchanger 14, 16 and enters a hollow air flux duct 78, 80. The duct is mounted to the heat exchanger housing 77, to surround an outlet port 82, 84 of the heat exchanger. The duct 78, 80, forms a part of an air distribution system 86, 88 for the cooling system 12.

It will be appreciated that the heat exchangers 14 and 16, and their associated air distribution systems 86, 88 are identical, arranged as mirror images of each other. For convenience therefore, one of the air distribution systems 86 will be described in detail, with the understanding that the other air distribution system 88 operates analogously.

With particular reference to FIG. 4, a cylindrical wall 89 of the air flux duct 78 is preferably formed of a fire retardant material, such as polycarbonate. The duct may have an axial length of about 4-8 cm and an internal diameter of about 16-26 cm.

With continued reference to FIG. 4, the air distribution system 86 also includes a fan and motor assembly comprising a rotating fan 90, driven by a fan motor 91. The fan 90 is preferably an axial fan, although it is contemplated that a radial fan may be employed. Axial fans are those which direct the air flow in a generally axial direction, indicated by axis X-X, which is parallel with the rotational axis of the fan 90. Air enters the fan in the same generally axial direction, via an inlet port 92 of the air flux duct 78. A suitable fan 90 is one with a flow rate of about 15-20 $m^3$/min, or higher. For example, the fan may have five to ten blades or impellers 94 having an effective diameter of 15-25 cm and rotate at about 2800 rpm.

As illustrated in FIG. 4, the blades 94 of the fan are located entirely within a cylindrically shaped internal passage 95 of the air flux duct 78, adjacent a circular outlet port 96 of the duct. The duct 78 is sized, at its outlet end 96, to provide a small clearance (e.g., about 0.02-0.1 cm) between the air flux duct and the fan blades 94. In this way, an inner surface 98 of the air flux duct wall 89 helps to maintain the generally axial flow direction of the exhausted air.

Figure 5:
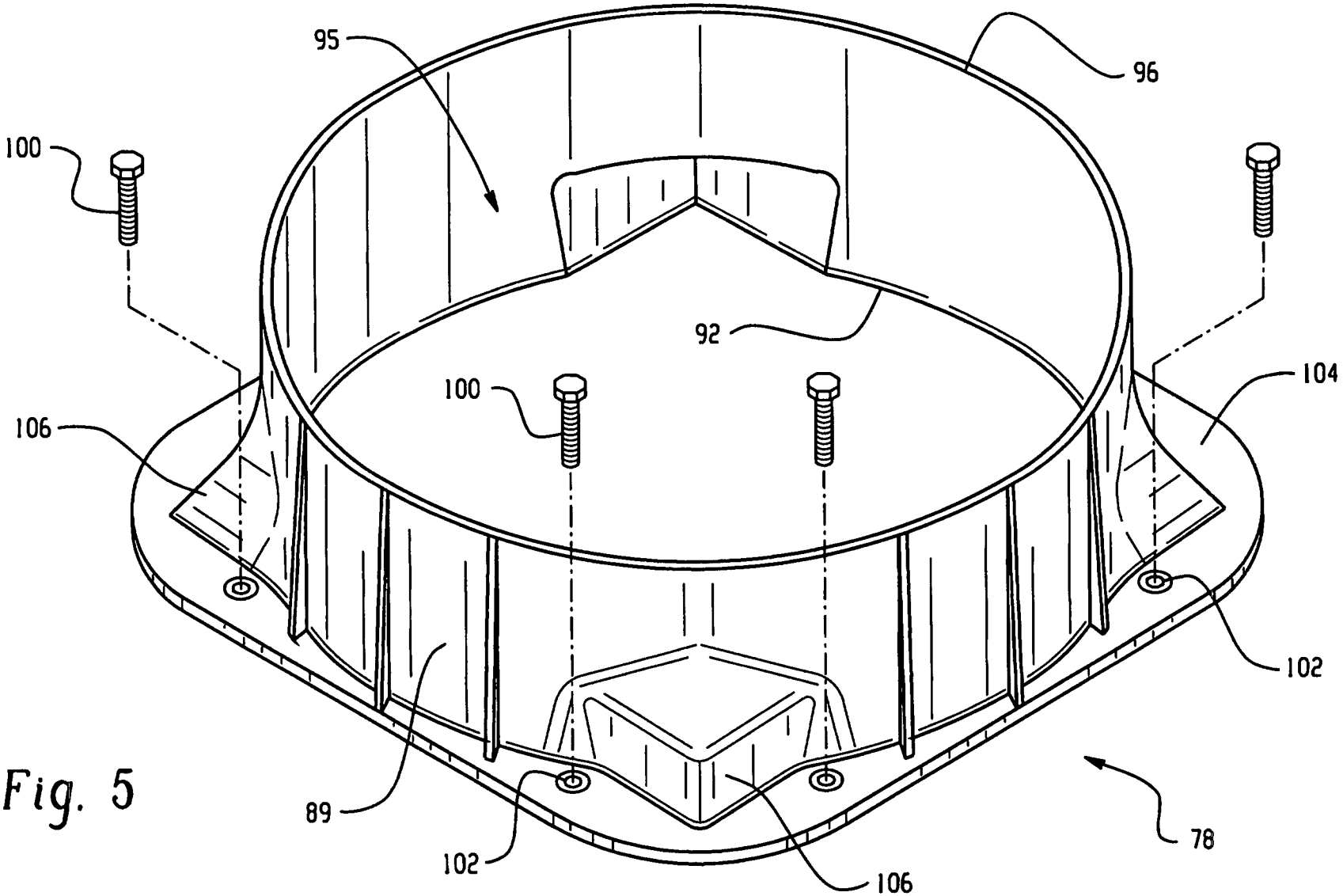
FIG. 5 is an enlarged perspective view of the air flux duct of FIG. 3.

As shown in FIGS. 4 and 5, the air flux duct 78 is mounted to the heat exchanger housing 77 with fixing members 100, such as screws, bolts, or the like, which pass through suitably positioned apertures 102 (four in the illustrated embodiment) in a peripheral flange 104 at the inlet end 92 of the air flux duct. Adjacent the inlet end 92, the air flux duct is widened, as necessary, to accommodate the size of the heat exchanger outlet port 82. In the illustrated embodiment, molded corners 106 of the air flux duct are shaped to allow the duct inlet port 92 to closely match the rectangular shape of the heat exchanger outlet port 82. The duct 78 thus provides a substantially airtight seal around the heat exchanger outlet port 82. In this way, all or substantially all the air leaving the heat exchanger outlet 82 enters the air flux duct 78.

The air exiting the outlet port 96 of the air flux duct 78 impinges on a contoured air flux director 110 which is axially aligned with and spaced from the outlet port. The air flux director intercepts the generally axial flow of air from the duct and directs the flow of air in a direction which is generally perpendicular to an axis of rotation of the fan 90 (i.e., the overall flow direction of the redirected air is closer to perpendicular than to axial). Specifically, the air flux director redirects the airflow through about 90° such that the air flows away from the air flux director in a generally lateral direction.

Figure 6:
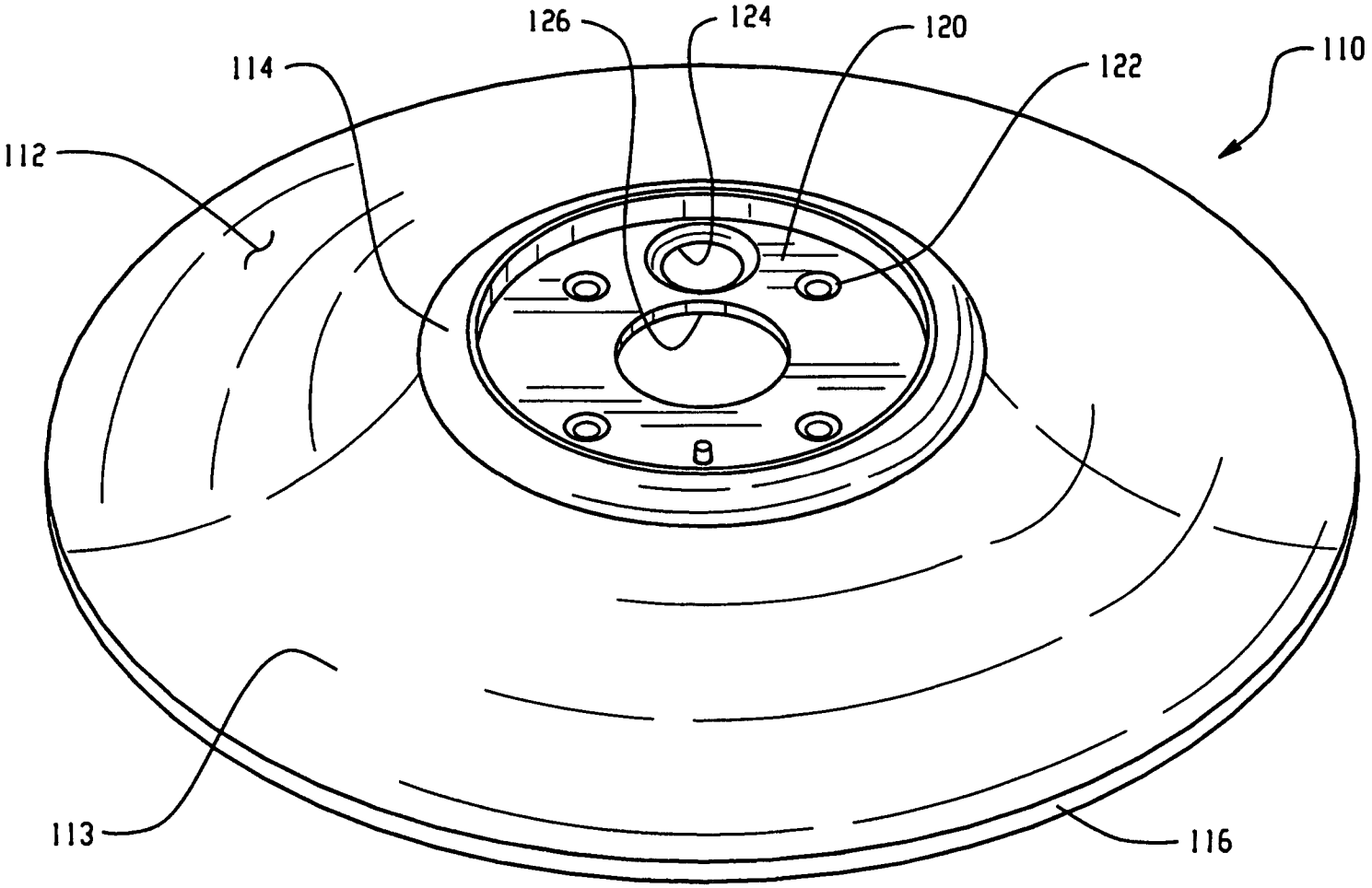
FIG. 6 is an enlarged front perspective view of air flux director of FIG. 3.
Figure 7:
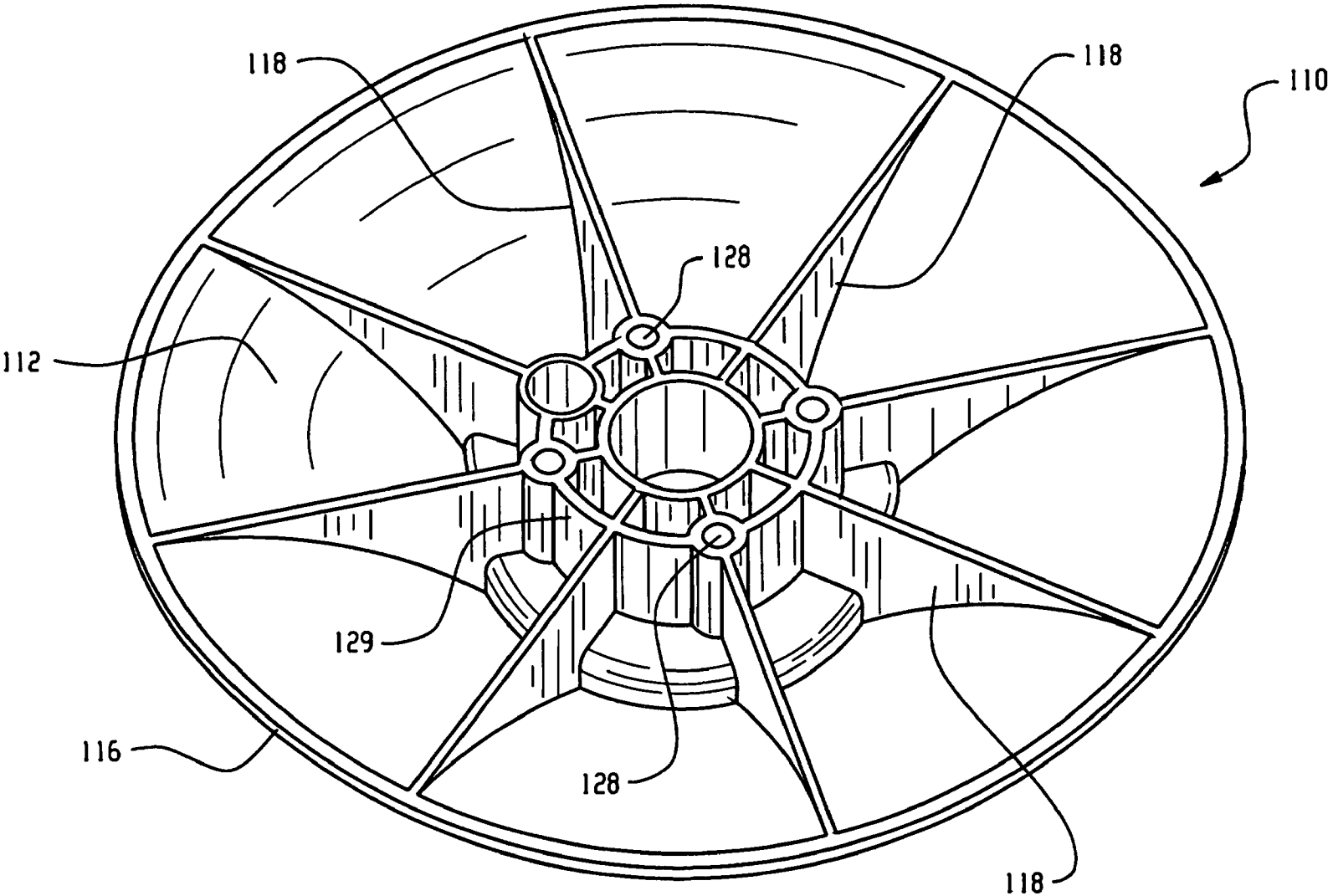
FIG. 7 is a rear perspective view of the air flux director of FIG. 6.

As best shown in FIGS. 6 and 7, the air flux director 110 includes a smoothly contoured disk or wall 112, shaped like a truncated cone, with an outer surface 113 which curves inwardly. The disk increases in its outer diameter from a fan end 114 adjacent the fan 90 to an outer end 116, furthest from the fan. In the illustrated embodiment the wall 112 is contoured with a radius of curvature r of, for example, about 8-10 cm in to reduce air constriction in the fan (FIG. 4). The outer diameter $d_d$ at the outer end 116 is larger than the diameter $d_f$ of the fan blades. For example, $d_d$ may be about 100-120% of the diameter of the circle enscribed by the fan blades 94. In the illustrated embodiment, $d_d$ is 20-30 cm, or greater. At the fan end, the diameter is smaller than the outer diameter of the fan blades. The diameter at the fan end is governed, in part, by the size of the fan motor mounted thereon. By directing the airflow along a curved pathway, illustrated by the arrows in FIG. 4, the air flux director reduces airflow noise which tends to result from turbulence.

The air flux director 110 is preferably formed of a fire retardant material, such as polycarbonate to keep its weight to a minimum and dampen vibration from the fan motor. The disk 112 may have a thickness of about 0.2-0.4 cm. Angularly spaced interior ribs 118 (eight ribs are illustrated in FIG. 7) are mounted to the disk 112 to help to maintain the rigidity of the air flux director 110.

The flux director 110 defines an axially aligned socket 120 at the fan end, sized to receive the fan motor 91 therein. Apertures 122 (four in the illustrated embodiment) in the socket 120 receive fixing members 123 (FIG. 4), such as screws, bolts, or the like, for mounting the fan motor 91 to the air flux director 110. Larger apertures 124, 126 are formed in the socket to receive wiring (not shown), portions of the motor, or the like. All of the apertures 122, 124, 126 are covered by the motor 91, such that little or none of the cooling airflow from the fan passes through the air flux director 110. As shown in FIG. 7, the screws are axially aligned with the ribs 118 and carried by bores 128 of an annular support structure 129, which, in combination with the ribs 118, allows the air flux director 110 to be substantially hollow, and thus lightweight, while providing a rigid support for the motor 91.

The air redirected by the air flux director 110 flows away from the heat exchangers though slots 130 milled in a cover 132 (FIG. 1) mounted over both air distribution systems 86, 88. The slots 130 are sized and positioned to allow sufficient outward flow so as not to inhibit the efficiency of the cooling system.

To reduce turbulence resulting from interference of the flow patterns from the two parallel fan systems, an air flux separator 140 is mounted to the outer end of the air flux director. The separator 140 consists of a flat plate formed, for example aluminum sheet. Although two parallel flux separators 140, 141 are illustrated in FIG. 1, one for each direction system 86, 88, it is also contemplated that a single air flux separator could be used between the two systems. The air flux separator 140 is sufficiently large in area to minimize turbulence. The separator is of a larger size than the air flux director 110 and is generally square or rectangular in shape, rather than round. The separator 140 has apertures 142, for receiving the motor mounting screws 123, whereby the motor 91 and the air flux director 110 are mounted to the air flux separator.

Alternatively, instead of a flux separator 140, the air flux director(s) could be formed with an outwardly extending flange (not shown) extending from its periphery.

Figure 8:
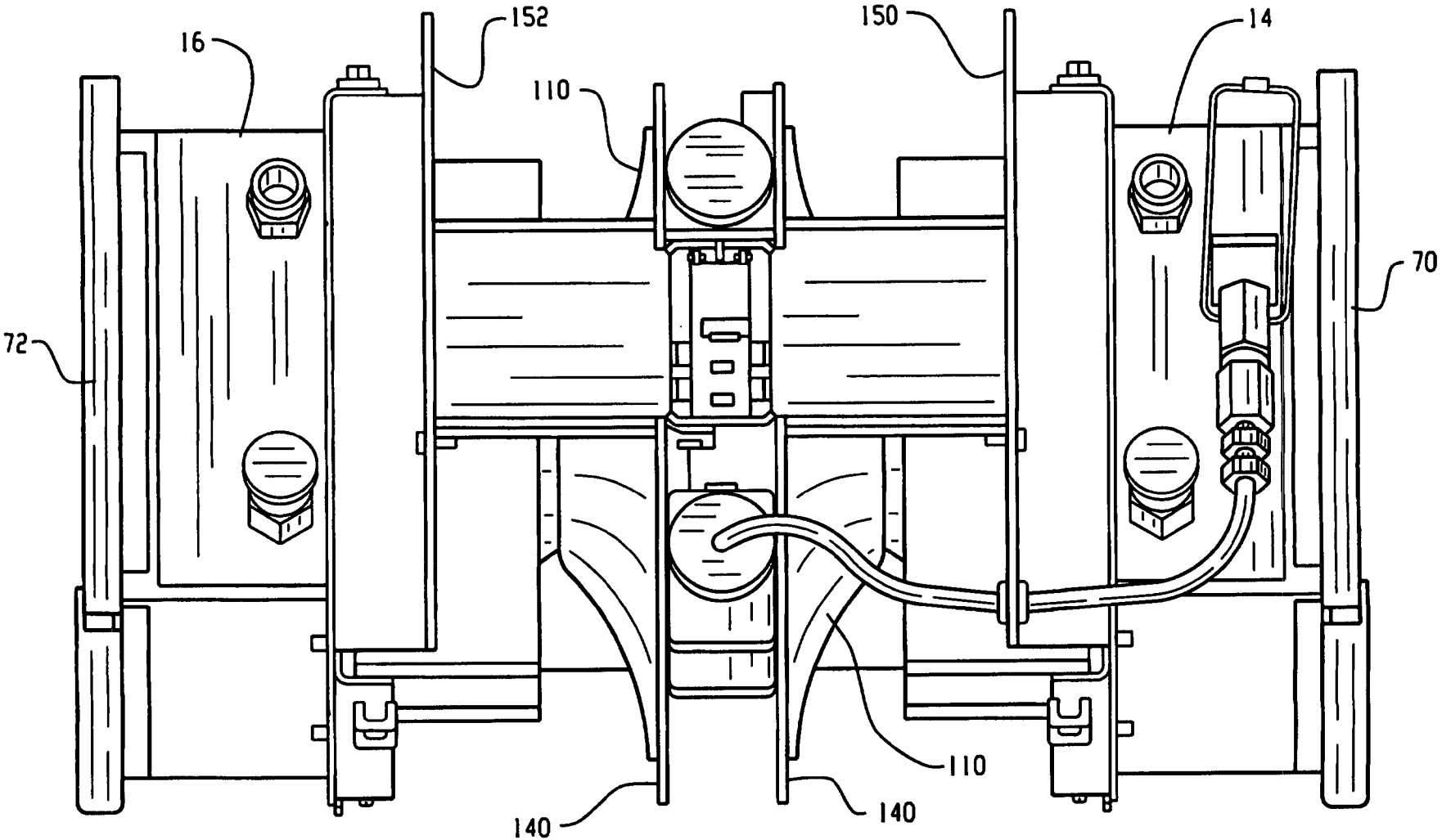
FIG. 8 is a top view of the cooling system of FIG. 3.
Figure 9:
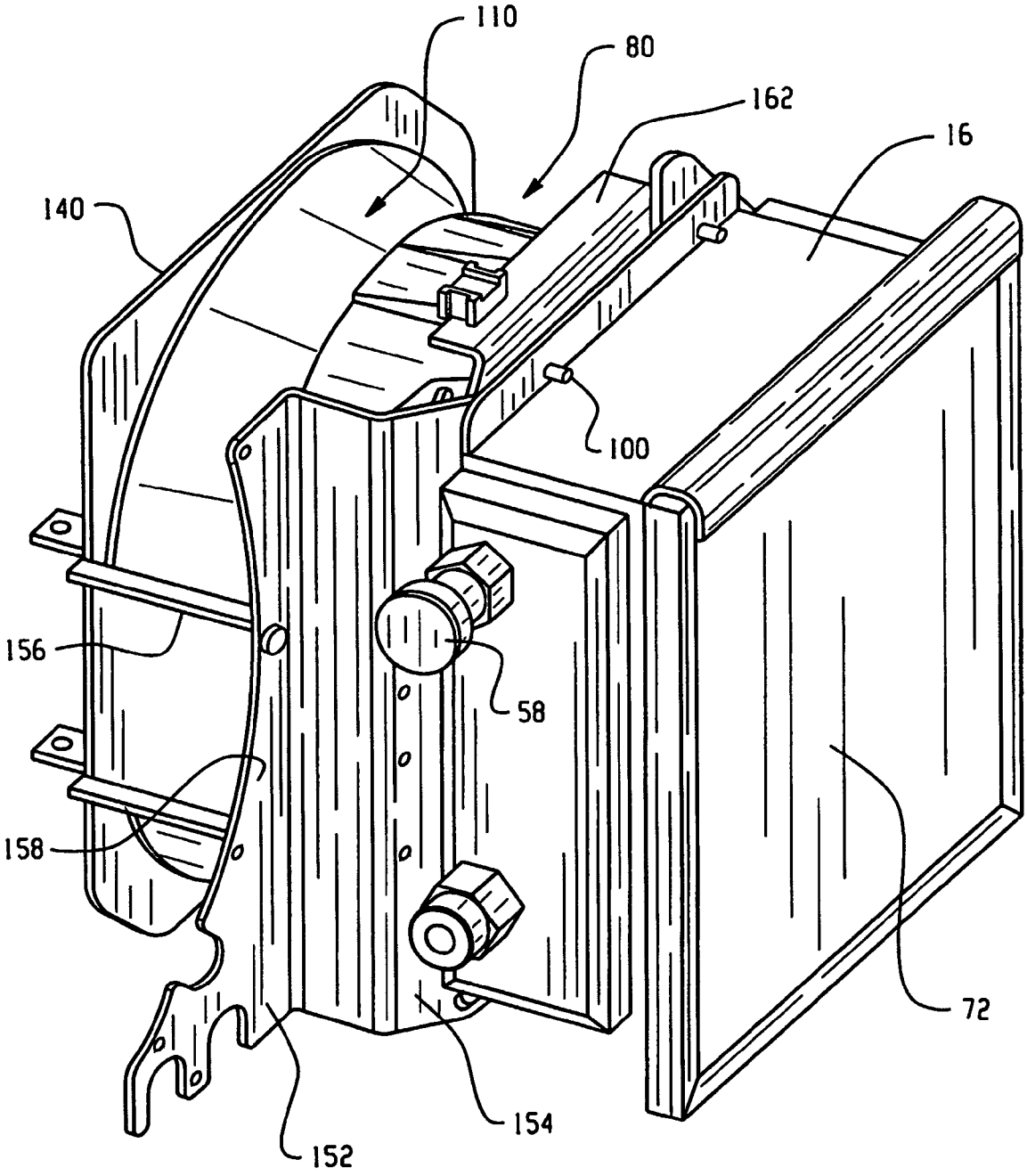
FIG. 9 is a perspective view of part of the cooling system of FIG. 3, showing a bracket for mounting the cooling system to the x-ray tube assembly of FIG. 1.

As shown in FIGS. 8 and 9, fan mounting brackets 150, 152 are attached to the heat exchangers 14, 16, respectively and serve as a base for the air flux director system 86, 88. Specifically, the brackets each include a plate 154, which is mounted to the heat exchanger housing 77, intermediate the air flux duct 78 and the heat exchanger, by the screws 100. Clamps 156 extend from the plate 154 and are fixed at their distal ends to the rear of the air flux separator 140. The bracket 150, 152 defines an outwardly extending side flange 158 which is mounted to the x-ray tube housing by suitably positioned fixing members, such as screws 160 (FIG. 1). The bracket also includes axially extending top and bottom flanges 162 (only the top flange is visible), to which the cover 132 is mounted with suitable fixing members.

Heat dissipation is increased as compared to a system without a flux director. Increases in heat dissipation of 23% or more have been found, which render the cooling system 12 suitable for use with higher gantry speeds and/or higher output x-ray tubes than has conventionally been possible. For example heat dissipation rates of at least 130 Watts/° C., and generally, about 140-150 Watts/° C., or higher, are readily achieved with the present system, as compared to 108 Watts/° C. with a conventional system.

Figure 10:
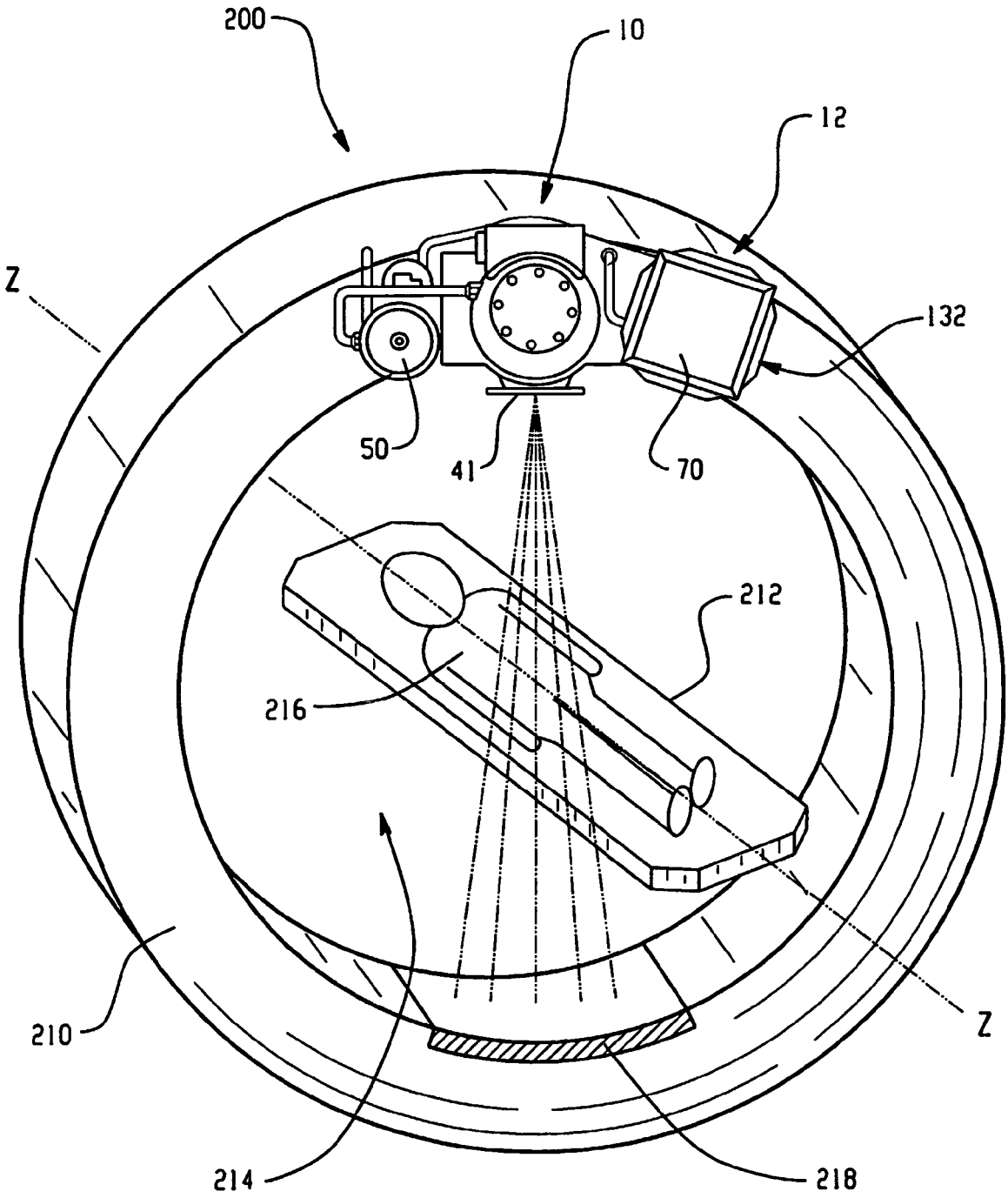
FIG. 10 is a perspective view of a CT scanner with the x-ray tube assembly and cooling system of FIG. 1.

As shown in FIG. 10, the cooling system described has a suitable weight and size for use in a computed tomography (CT) system 200. The CT system 200 includes an annular shaped gantry 210 which is rotatable about a gantry axis Z. The x-ray tube 10 and its associated cooling system 12 are mounted to the gantry. A patient support 212 is translated parallel to the Z axis though an examination region 214 within the gantry. X-rays passing through a subject 216 on the support are received by an arc of detectors 218 mounted to an opposite side of the gantry from the x-ray tube assembly 10. X-ray data representing a body structure of the subject is used to reconstruct an image of the body structure using an appropriate data processing and reconstruction system (not shown).

The axis of rotation X of the fans remains parallel to the axis of rotation Z of the gantry 210. While the cooling system 12 has been described as being mounted to the x-ray tube housing 40 by brackets 150, 152, it is contemplated that the cooling system may alternatively be mounted to the gantry 210.

Without intending to limit the scope of the invention, the following Example demonstrates the effectiveness of the cooling system.

Various cooling systems were constructed using either parallel paired radial fans or parallel paired axial fans of the type described previously. The axial fan (18.8 $m^3$/min flow rate at zero pressure drop, rotational speed 2,800 RPM, 20 cm blade diameter, with 9 blades) was supplied by the manufacturer with an outer frame (axial w/frame) formed of steel. The frame was removed in some tests prior to inserting the fan into the air flux duct (axial, no frame). Different types of filter were tested, including no filter, a 10 ppi filter, and a 25 ppi filter, the 10 ppi having larger holes and thus a less flow resistance than the 25 ppi filter. In these tests, the air flux duct was fairly crudely formed with a cylindrical shape (about 20 cm long), which did not completely cover the heat exchanger outlet. The air flux director was cut to shape, rather than molded (21 cm outer diameter, radius of curvature, 9.5 cm). In some tests, air flux separators were used, formed of aluminum sheet about 0.2 cm in thickness.

TABLE 1 shows the results obtained. Preferred configurations are generally those which have lower oil temperatures and higher heat dissipation rates (Q/ITD=rate/(hot oil temperature-cold oil temperature)). However, other factors, such as fan noise and tendency towards vibration also tend to be important in assessing the suitability of the configuration for use in CT scanners.

The axial fan, without its manufacturers frame, performed well in the tests, particularly when combined with a duct, an air flux director, and air flux separator and a slotted cover. Test 13, for example has a heat dissipation rate of 132 Watts/° C., which compares very favorably with a conventional heat exchanger design having a heat dissipation rate of 108 W/° C. This arrangement also had low noise output and reduced vibration, as compared with conventional fans.

Tests similar to those described for EXAMPLE 1 were carried out with a cooling system comprising 2 heat exchangers, 2 axial fans, 2 ducts, 2 air flux directors, and 2 separators. In these tests, the air flux duct was molded to provide corner pieces as shown in FIG. 5 to allow the air flux duct to more closely match the shape of the heat exchanger outlet. The duct outlet diameter was designed to be closer to that of the fan blades than in EXAMPLE 1, allowing the fan to operate more efficiently. The flux director was also increased in size, from about a 21 cm maximum diameter to a 24.6 cm maximum diameter and molded to provide a smoother outer surface than the rough cut director used in EXAMPLE 1. These changes were found to reduce air flow friction and turbulence so that heat dissipation efficiency was improved. The heat dissipation results (Q/ITD) are shown in TABLE 2 and compared with those for a commercial cooling system operating with radial fans. For each test, the power to the anode, stator, and pump was the same (4500 W, 400 W, and 187 W, respectively). The heat dissipation from the x-ray tube housing was therefore the same for each configuration (350W). Predicted maximum cooling oil temperatures were based on a gantry temperature of 37° C.

TABLE 2

| Configuration | Q/ITD, W/° C. | Predicted maximum cooling oil temperature, ° C. |
|---|---|---|
| Commercial cooling system (with radial fan) | 126 | 73 |
| Cooling system with axial fan, duct, air flux director, and air flux separator | 150 | 67 |

As can be seen from TABLE 2, the present cooling system outperformed the commercial cooling system in terms of heat dissipation rate. The maximum cooling oil temperature was also significantly lower for the present system than for the commercial system. Based on the results obtained, the present cooling system is capable of maintaining very effective cooling of an x-ray tube operating at a power of at least 4.5 KW by maintaining the oil temperature at less than 63° C. If the oil temperature is allowed to be slightly higher, the cooling system is expected be able to maintain effective cooling of an x-ray tube which operates at about 6 KW, which is much higher than current commercial cooling systems are able to handle.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiment, the invention is now claimed to be:

1. A cooling system (12) for use with an associated x-ray tube assembly (10) comprising:

a heat exchanger (12,14) which receives cooling fluid from a housing (40) of the associated x-ray tube assembly and transfers heat between the cooling fluid and a flow of air;

an axial fan (90) disposed to move the flow of air through the heat exchanger, the axial fan having fan blades with a size and shape to receive air flow along a path substantially parallel to an axis of rotation of the fan blades and to discharge air flow along a path substantially parallel to the axis of rotation of the fan blades; and an air flux director (110) positioned to intercept the flow of air from the heat exchanger and to redirect the flow of air in a direction which is generally perpendicular to an axis of rotation of the fan.

2. The cooling system of claim 1, wherein the air flux director defines a truncated cone with a concave outer surface (113).

3. The cooling system of claim 1, wherein the air flux director is spaced from the fan along the rotational axis of the fan.

4. The cooling system of claim 3, wherein the air flux director is aligned with the rotational axis of the fan.

5. The cooling system of claim 1, wherein the fan is positioned intermediate the heat exchanger and the air flux director.

6. The cooling system of claim 5, wherein the fan includes blades (94) which have a diameter which is less than a maximum outer diameter of the air flux director.

7. The cooling system of claim 5, wherein the fan includes a motor (91), the motor being mounted to the air flux director.

8. The cooling system of claim 1, further including a duct (78) which receives air from the heat exchanger and diminishes in cross section toward the air flux director, the fan blades being located entirely within a cylindrically-shaped passage defined by a continuous annular wall of the duct.

9. The cooling system of claim 8, wherein the fan includes radial blades (94) which are positioned within the duct.

10. The cooling system of claim 9, wherein the air flux director defines a truncated cone with a concave outer surface (113), the duct, the fan blades, and the air flux director being coaxial.

TABLE 1

| Test | Fan | Air Flux Separator | Air Flux Duct | Air Flux Director | Air Filter, PPI | Fan Weight, Ib (one side) | Cover | Highest Oil Temp, ° C. | Q/ITD, W/C |
|---|---|---|---|---|---|---|---|---|---|
| 1 | Radial | No | No | No | 25 | 3.5 | Yes | 63 | 134 |
| 2 | Axial, no frame | Yes | No | Yes | 25 | 3.8 | Yes | 65.4 | 100.22 |
| 3 | Axial, no frame | Yes | No | Yes | 25 | 3.9 | Yes | 63.3 | 105.5 |
| 4 | Axial, w/frame | Yes | No | No | 25 | 4.7 | Yes | 68 | 108 |
| 5 | Axial, w/frame | Yes | No | No | 25 | 4.7 | No | 63.4 | 125.2 |
| 6 | Axial, w/frame | Yes | No | No | 25 | 4.7 | Yes | 69 | 109.8 |
| 7 | Axial, w/frame | Yes | No | No | 25 | 4.7 | No | 67.0 | 108 |
| 8 | Axial, w/frame | Yes | No | No | 25 | 4.7 | No | 63.0 | 125 |
| 9 | Axial, w/frame | Yes | No | No | None | 4.7 | No | 59.5 | 142.5 |
| 10 | Axial, w/frame | Yes | No | No | None | 4.7 | Slotted cover | 63 | 127 |
| 11 | Axial, no frame | Yes | Yes | Yes | None | 4.2 | Slotted cover | 63 | 145 |
| 12 | Axial, no frame | Yes | Yes | Yes | 10 | 4.2 | Slotted cover | 63.2 | 133 |
| 13 | Axial, no frame | Yes | Yes | Yes | 25 | 4.2 | Slotted Cover | 62.6 | 132 |

11. The cooling system of claim 1, further including: a second heat exchanger mounted in parallel with the first heat exchanger; a second fan disposed to move a second flow of air through the second heat exchanger; and a second air flux director positioned to intercept the second flow of air from the second heat exchanger and redirect the second flow of air in a direction which is generally perpendicular to an axis of rotation of the second fan.

12. The cooling system of claim 11, further including: at least a first air flux separator (140), positioned intermediate the first and second air flux directors, to reduce turbulence created by intermixing of the first and second flows of air.

13. The cooling system of claim 12, wherein the first and second air flux directors are mounted back-to-back.

14. The cooling system of claim 12, further including: a second air flux director which defines a truncated cone with a concave outer surface; a second duct; and a second fan, fan blades of the first and second fans, the first and second ducts, and the first and second air flux directors being coaxial.

15. An assembly comprising: an x-ray tube (32) mounted in a housing (40); the cooling system (12) of claim 1; and a pump (52) which circulates the cooling fluid through the housing and the cooling system of claim 1.

16. The assembly of claim 15, wherein the x-ray tube has a power input of at least 4.5 KW.

17. A CT system (200) comprising: a gantry (210) mounted for rotation about a gantry axis; an x-ray tube (32) mounted in a housing (40); the cooling system (12) of claim 1; and a pump (52) which circulates the cooling fluid through the housing and the cooling system of claim 1 supported by the gantry; and, an array (218) of x-ray detectors mounted to the gantry opposite to the x-ray tube.

18. An x-ray tube assembly and cooling system comprising:

an x-ray tube (32) for generation of x-rays;

a fluid flow path (46) which carries heated cooling fluid from the x-ray tube (32) and returns cooled fluid to the x-ray tube; and a cooling system (12) including: an axial fan (90) which is disposed to move a stream of air past a portion of the flow path, the fan having an axis of rotation the fan being an axial fan having fan blades with a size and shape to receive air flow along a path substantially parallel to an axis of rotation of the fan blades and to discharge air flow alone a path substantially parallel to the axis of rotation of the fan blades; and an air flux director (110) axially spaced from the fan and shaped to radially deflect air exhausted by the fan.

19. A method for cooling an x-ray tube assembly (10) comprising:

receiving a heated cooling liquid from the x-ray tube assembly through a fluid flow path;

transferring heat between the cooling liquid and a flow of air generated by a fan (90), the fan exhausting the air flow in a direction generally parallel with its axis of rotation, the fan being an axial fan having fan blades with a size and shape to receive air flow along a path substantially parallel to an axis of rotation of the fan blades and to discharge air flow along a path substantially parallel to the axis of rotation of the fan blades;

deflecting the exhausted air off of an air flux director in a radially outward direction which is generally perpendicular with the axial direction.

* * * * *